United States Patent [19]

Humphries, Jr. et al.

[11] 4,045,677

[45] Aug. 30, 1977

[54] INTENSE ION BEAM GENERATOR

[75] Inventors: Stanley Humphries, Jr.; Ravindra N. Sudan, both of Ithaca, N.Y.

[73] Assignee: Cornell Research Foundation, Inc., Ithaca, N.Y.

[21] Appl. No.: 695,219

[22] Filed: June 11, 1976

[51] Int. Cl.[2] ..... H01J 27/00

[52] U.S. Cl. ..... 250/423 R; 315/111.8

[58] Field of Search ..... 250/423 R; 315/111.8

[56] References Cited

U.S. PATENT DOCUMENTS

| | | | |
|---|---|---|---|
| 3,705,998 | 12/1972 | Jennings et al. | 315/111.8 |
| 3,890,535 | 6/1975 | Gautherin et al. | 250/423 |
| 3,924,134 | 12/1975 | Uman et al. | 250/423 |

FOREIGN PATENT DOCUMENTS

| | | | |
|---|---|---|---|
| 1,242,018 | 6/1967 | Germany | 250/423 |

*Primary Examiner*—Alfred E. Smith
*Assistant Examiner*—T. N. Grigsby
*Attorney, Agent, or Firm*—Jones, Tullar & Cooper

[57] ABSTRACT

Methods and apparatus for producing intense megavolt ion beams are disclosed. In one embodiment, a reflex triode-type pulsed ion accelerator is described which produces ion pulses of more than 5 kiloamperes current with a peak energy of 3 MeV. In other embodiments, the device is constructed so as to focus the beam of ions for high concentration and ease of extraction, and magnetic insulation is provided to increase the efficiency of operation.

15 Claims, 7 Drawing Figures

FIG. 1
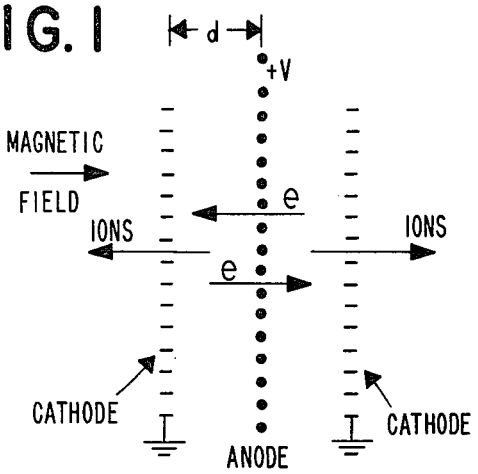
FIG. 2
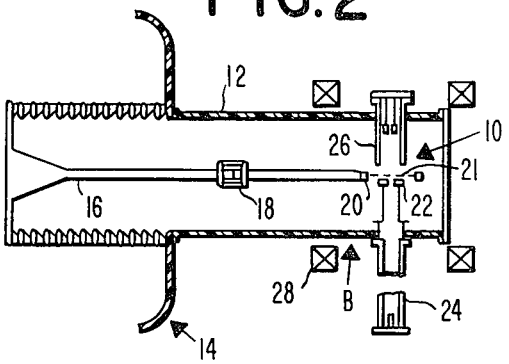
FIG. 3
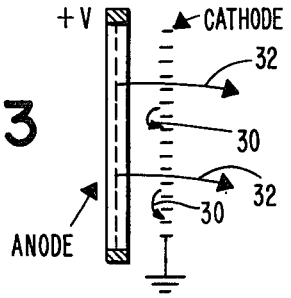
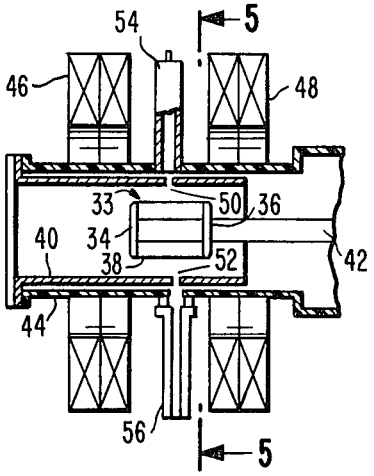
FIG. 4
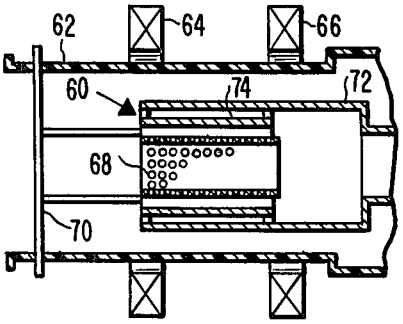
FIG. 6
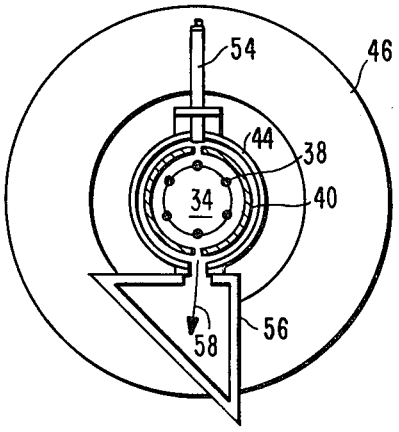
FIG. 5
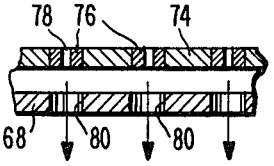
FIG. 7

INTENSE ION BEAM GENERATOR

The invention herein described was made in the course of or under a contract or subcontract thereunder with the Offices of Naval Research and the Energy Research and Development Administration.

BACKGROUND OF THE INVENTION

The present invention relates, in general, to methods and apparatus for generating intense ion beams, and more particularly to methods and apparatus for generating ion beams in the megavolt range and for controlling and concentrating the beams so generated.

The production of high current electron beams has been accomplished in the past, typically by the application of a high voltage pulse in the range of 0.5 to 10 MeV of 50 nanoseconds (nsec) length, to a diode consisting of closely spaced metal anode and cathode surfaces. The high voltage extracts from the cathode surface electrons which are accelerated across the diode gap in the form of a beam. The electron current across the diode is described approximately by the Child-Langmuir law for space-charge-limited flow if account is taken of the fact that the effective cathode-anode gap decreases rapidly during a pulse as a result of plasmas created adjacent the anode and cathode, which plasmas expand during the course of the pulse to reduce the spacing. The electron current produced in this manner finds extensive application in the art, particularly as a high energy source for producing X-rays.

Such electron beams are limited in some uses, because the mass of an electron is extremely small. It was recognized, however, that if a high current could be produced using more massive particles such as ions, the resulting beams would have a number of important applications, for an intense ion beam could be used to rapidly heat a plasma to fusion temperatures, and could find use in nuclear studies for producing intense neutron fluxes, isotope fluxes, and the like. For example, a fusion reaction can be produced in an isotope of hydrogen by the application of pressure to increase the density of the isotope to 100 - 1000 times its normal value, thereby creating heat which results in a nuclear fusion reaction. Literally millions of atmospheres of pressure are required to produce such a reaction, however, and a source of energy for accomplishing this has long been sought. High powered beams of particles such as electrons were considered, but it was anticipated that the required pressure could better be applied by high energy, intense beams of particles such as ions.

An attempt was made to generate such an ion beam by utilizing the diode arrangement from which electron beams were derived, and to this end voltages in the range of 0.5 to 10 MeV were applied across closely spaced diode plates in pulses of approximately $10^{-7}$ seconds duration. However, at such high voltages and such short durations, it was found that electrons would be pulled out of the cathode surface readily, but that ions could not easily be pulled out of the solid metal anodes. In operating such devices, it was found that an electron diode will under very high voltage conditions produce a plasma on the anode, and thus provide a source of ions which can be accelerated toward the cathode. This was, however, an inefficient way to produce an ion beam, since less than 2.5 percent of the available energy was put into the ions, the remainder being utilized to accelerate electrons from the cathode surface. This is because, for the same energy and current, the ions move more slowly and constitute a larger space charge, and the space charge for both ions and electrons limit their flow.

In order to obtain the desired ion flow, it was found that it would be necessary to provide a suitable material at the anode that would readily release ions. At the same time, means would be required to suppress the relatively light and easily moved electrons, for the normally occurring electron current utilized most of the pulse energy. Thus, the problem was faced as to how to produce a suitable source of ions within the time limit of the applied pulse; that is, in less than $10^{-8}$ seconds, and also how to produce a significant flow of such ions in such a way as to produce a recoverable, and thus useable ion beam current. Consideration was given to the use of lasers or other energy sources to create a layer of plasma at the anode of the diode device, which plasma could then serve as a source of ions. These and other considerations failed to produce the desired results, however, because the flow of electrons in such devices consumed virtually all of the available power and effectively prevented the flow of ion current.

An early solution to some of the foregoing problems was the provision of an arrangement of the type diagrammatically illustrated in FIG. 1. In this type of device, the anode is constructed of a mesh which is highly transparent to electrons, preferably passing approximately 95 percent of the electrons accelerated towards it. The mesh is made of a damage-resistant material such as tungsten, and is coated with a material that will provide the required source of ions. For example, an absorbed monolayer of $H_2$ could be utilized to provide a source of Hydrogen ions, or protons, while other coating materials such as hydrocarbons may be utilized for this purpose. Two cathode plates at ground potential are located symmetrically, one each side of the anode, and thus the device may be referred to as a triode, although it is more in the nature of a double diode. A pulsed voltage applied to the anode causes electron field emission so that a space charge limited electron current leaves each cathode. About 5 percent of this current collides with the anode and constitutes an electron current drain for the device. The remaining electrons continue through the anode to the opposite cathode. The current leaving each cathode is about ½ the Child-Langmuir current since the returning electrons effectively double the space charge between the cathode and anode, so that the total current approaching the anode is the current that would result from a vacuum diode of spacing $d$ nd voltage V.

The electrons which collide with the anode produce a plasma around the anode which is transparent to the high energy electrons. Ions are emitted from the plasma at the space charge current density appropriate to the effective spacing of the diode electrodes and are accelerated towad both cathodes. This continues until the plasma has expanded to fill the gap between the electrodes and shorted out; about 50 - 100 nanoseconds. With this construction, the electron current is reduced by a factor of 20, and for a source of hydrogen ions (protons) about one-third of the available energy is put into the ions. Further, since there is an excess of electrons around the cathodes, and the electrons need only a small energy to follow the ions, the flow of ions constitutes an electrically neutral plasma, making it possible to propagate the resulting flow of ions through a vacuum with the divergence properties of the beam being determined by the initial direction of emittance of the ions. The principle of operation of a triode such as that illustrated in FIG. 1 is further described in an article entitled "Generation of Intense Pulse Ion Beams" published in *Applied Physics Letters,* Vol. 25, No. 1, July 1, 1974, pages 20 - 22.

In a further development of the triode of FIG. 1, it was found that only one real cathode is necessary for the operation of the device, provided that the triode is surrounded by a region of ground potential. Upon removal of one of the cathodes, electrons emitted by the remaining cathode and passing through the anode to enter the vacant side will, by their own space charge, produce a virtual cathode at their turning point, which will be at a substantially the same distance from the anode as the real cathode. This simplifies construction of the triode, and allows extraction of ions from the vacant side through a perfectly transparent cathode. This construction is referred to herein as a reflex triode.

Although the reflex triode discussed above produced improved results, it was found that a substantial loss in energy occurred adjacent the edges of the cathode, for electrons emitted at these areas travelled quickly to the support structure for the anode, which structure is opaque to electron flow, and thus these electrons constituted a current flow which consumed a significant part of the power applied to the device. To prevent this loss, a magnetic field parallel to the triode axis, with lines of flux extending across the anode-cathode gap, and of a sufficient strength to prevent electron drift outwardly from the mesh portion of the anode is provided.

As indicated above, the loss of electrons by impact on the anode mesh can be utilized as a source of energy for formation of a plasma. The metal mesh material may be coated with hydrocarbons which have been found to be good proton sources. However, coated metal anodes are generally slow in the production of plasma, compared to the pulse length of the applied voltage, and a better solution has been found to be the use of initially nonconducting meshes of hydrocarbons such as nylon. It has been found that at the beginning of a pulse, large electrical fields are produced along the nylon threads which make up the mesh. These fields are believed to cause a surface breakdown which rapidly produces a plasma that is then maintained by the circulating electrons. The operation of a reflex triode is described in an article entitled "Advances in the Efficient Generation of Intense Pulse Proton Beams" published in the *Journal of Applied Physics,* Vol. 46, No. 1, January, 1975, pages 187 - 192.

Although reflex triodes of the type described above have been useful in confirming the theory that an ion flux can in fact be produced in a controllable and predictable manner, nevertheless such devices left unsolved numerous problems relating to the practical applicability of such ion streams. For example, the reflex triode operation produces a flow of ions over a relatively large area at a relative low power level. This left open the question of how to collect the ions so produced and to focus them into a beam which could produce useable amounts of energy at a predetermined target.

SUMMARY OF THE INVENTION

Accordingly, it is an object of the present invention to provide a source of ion beams which is capable of producing a stream of ions at a high energy level and with increased efficiency.

It is a further object of the present invention to provide an ion stream of high energy wherein the flow of ions is directable and thus can be focused on a target.

Another object of the invention is to provide means whereby a concentrated and focused stream of ions can be produced with high efficiency and with a high level of energy.

Briefly, the present invention is directed to a method and apparatus for producing intense pulsed fluxes, or ion beams, in an efficient manner to produce particles having a high energy content in a controllable and directable beam. In accordance with the invention ion beams are produced at voltages of 1.8 MeV with currents in excess of 5 kiloamps in bursts of energy of as much as 3 MeV. To accomplish these results, the reflex triode of the prior art is modified to permit the application of very high anode voltages, with variations in the anode material producing various ion densities and energies. In particular, the use of a nylon mesh which emits protons produces good results at the very high voltages. Further modifications of the reflex discharge device include a construction wherein the anode and the cathode comprise coaxial cylinders, the anode being located within and closely spaced to the cathode. A magnetic field is applied which insulates the anode from the cathode to prevent electrons from crossing the gap but allowing the heavier ions to cross. In addition, because the electrons are no longer available to bombard the anode material to produce the required ion-emitting plasma, the material of the anode is selected to emit ions under the influence of the high electrostatic fields applied. To facilitate collection of the ions, the polarity of the device may be reversed so that the ions travel inwardly of the cylinder for collection at the center thereof, rather than being accelerated radially outwardly. In this form, the anode is exterior of the cathode, and the cathode must be made transparent to the ions for proper operation.

To further facilitate the flow of ions from the external anode to the center of the device, the anode is shaped to provide ion emission in selected areas of the anode so that ions will be emitted in areas radially opposite the openings in the cathode, thus insuring that a maximum number of ions will flow to the center of the device and thus improving the efficiency thereof. Further, to prevent excessive bending of the ion paths due to the applied magnetic fields which are necessary to control the flow of electrons, means are provided for pulsing the magnetic field so that this field is limited to the area between the anode and the cathode. This insures that the ions will flow in a generally linear path toward the axis of the device, thereby improving the focus and producing a high intensity at the focal point. Devices to which the ion beams are to be applied may then be located within the ion generator, or means may be provided for extracting the ions, as desired.

BRIEF DESCRIPTION OF THE DRAWINGS

The foregoing and additional objects, features and advantages of the present invention will become apparent to those of skill in the art from a consideration of the following detailed description thereof, taken in conjunction with the accompanying drawings in which:

FIG. 1 is a diagrammatic illustration of an ion generator of the prior art;

FIG. 2 is a diagrammatic cross-sectional view of an improved ion generator operating as a reflex triode;

FIG. 3 is a diagrammatic illustration of the principle of magnetic insulation;

FIG. 4 is a diagrammatic cross-sectional view of a reflex diode ion generator having magnetic insulation;

FIG. 5 is a cross-sectional view of the generator of FIG. 4, taken along line 5—5 thereof;

FIG. 6 is a diagrammatic cross-sectional view of a modified form of the device of FIG. 4; and FIG. 7 is an enlarged view of a portion of the anode and cathode of the ion generator of FIG. 6.

DESCRIPTION OF PREFERRED EMBODIMENTS

As has been indicated, one of the problems encountered in the production of a useful ion flux has been obtaining an ion beam of sufficient intensity to provide a high level of energy at a target. Apparatus for obtaining a high intensity beam is illustrated in FIG. 2, to which reference is now made. In this device, a reflex triode ion generator generally indicated at 10 is mounted within a vacuum housing 12 secured to a conventional Blumlein line which is capable of providing very high voltages in extremely short pulses. The Blumlein line is diagrammatically illustrated at 14 and, as indicated, is essentially a coaxial transmission line which may be oil filled or water filled and which is capable of delivering on a central conductor 16 voltages as high as 5 MeV. A switch 18 may be incorporated in the center conductor, if desired, to regulate the application of the voltage pulses.

The central conductor 16 extends into the center of the vacuum housing 12, and is adapted to support an anode ring 20 which forms a part of the reflex triode 10. The anode ring is adapted to support a variety of anode materials, including foils, meshes, or the like indicated at 21, as discussed above. A real cathode 22 is secured to the housing 12, and is connected to ground by way of the exterior conductor of the Blumlein line. In the disclosed embodiment, the cathode is provided with a small hole in the center thereof which allows a portion of the ion stream produced by the device to flow toward the real cathode to be extracted for study in a drift tube 24. On the side of the anode opposite to the real cathode, a virtual cathode exists, as discussed above, but no structure exists to interfere with the travel of ions released from the anode material in that direction. These ions may be collected in an extraction pipe 26. A magnetic field B is provided along the axis of the reflex triode 10 by suitable magnetic field coils 28. This axial magnetic field prevents electron edge loss by constraining the flow of electrons to the area within the anode ring 20.

With a highly transparent anode material, electrons emitted by the cathode **22*a*** circulate within the reflex triode, with those electrons which strike the anode material serving to produce a plasma adjacent the anode. Although dense plasmas formed by the electrons are necessary for ion extraction, they have the disadvantage of producing fast triode closure, or short circuiting, in some cases.

By constructing the anode of an aluminum foil, dense plasmas with delayed diode closure are produced; further, with a nylon mesh anode, significant hydrogen ions are obtained. The aluminum foil may be, for example, $5 \times 10^{-4}$ cm thick, and with such a material, diode closure is delayed for at least 130 nanoseconds, producing a beam current density in excess of 30 A/cm$^2$ with a peak applied anode voltage of less than 1.8 MeV. Further details of the construction of this reflex triode may be found in an article entitle "Production of Intense Megavolt Ion Beams With a Vacuum Reflex Discharge", published in *Applied Physics Letters,* Vol. 26, No. 12, on June 15, 1975, pages 667 - 670.

Although the reflex triode arrangement described with respect to FIG. 2 provides a vast improvement over prior methods and devices for obtaining ion beams, it was found that the efficiency was not as high as desired, apparently because the circulating electrons tended to migrate in the magnetic field in a direction toward the anode ring, eventually striking that ring, and producing a current which represented a loss of energy to the beam being generated.

In an attempt to improve the efficiency of the beam generator, a construction such as that illustrated in FIG. 3 was devised. In this embodiment, the anode and cathode are both formed of a mesh which is transparent to both electrons and ions. The two electrodes are planar and parallel to each other, and a magnetic field is applied in a direction such that the lines of force extend parallel to the two electrodes and perpendicular to the drawing as illustrated in FIG. 3. This magnetic field is of sufficient strength to deflect the electrons emitted by the cathode under the influence of a voltage applied to the anode, causing the electrons to follow curved paths such as those indicated by the arrows 30 in FIG. 3. With the proper field strength, the deflected electrons return to the cathode, as illustrated, thus preventing any current flow to the anode and effectively magnetically insulating the cathode and the anode from each other. Since the mass of an ion is approximately 2000 times that of the mass of an electron, the radius of bend of ions and electrons has approximately the same ratio. Thus, a field which causes the electrons to return to the cathode will have only a slight effect on the ions, as indicated by the arrows 32 in FIG. 3 and the ions will cross the gap between the anode and the cathode and will pass through the cathode mesh.

The construction illustrated in FIG. 3 introduces two problems, however. First, the magnetic field causes each electron to curve downwardly (or, with an opposite magnetic field, upwardly), causing the electrons to collect at one end of the cathode. This accummulation of electrons eventually causes a breakdown of the gap between the anode and the cathode. Further, because no electrons flow to the anode in this configuration, there is no bombardment of the anode and thus no creation of a plasma. Where this plasma source is required for production of ions, this arrangement is found to be unsatisfactory.

In accordance with the present invention, however, these difficulties are overcome by means of the construction illustrated in FIGS. 4 and 5, to which reference is now made. This system uses the diode high voltage pulse technology for generating ion streams, but in addition provides magnetic insulation to improve the efficiency of the device. Further, means are provided for introducing a uniform, large-area plasma on the anode to act as an ion source, and a cylindrical configuration is provided for the cathode to overcome the problem of electron accumulation described with respect to FIG. 3. By providing a cylindrical cathode, the deflected electrons circulate around the circumference of the cathode and do not accumulate in any one spot, thus avoiding the problem of breakdown previously described.

To solve the problem of a lack of ion bombardment of the anode, the anode is also constructed in a cylindrical form, coaxial with the cathode and located within it. The anode 33 consists of two spaced copper discs, or armatures, illustrated at 34 and 36 in FIG. 4. Connected between these two armatures is a plurality of nylon strings 38 spaced around the outer edges of the armatures to define a cylindrical anode surface. As shown in FIG. 4, the cylindrical anode is coaxial with and spaced inwardly from the cylindrical cathode 40. Energy is supplied to the anode by way of a Blumlein line which provides a voltage, for example 200 keV on an inner conductor 42 to the anode 33. The anode and cathode are mounted within a vacuum housing 44 to which suitable vacuum pumps may be connected.

A magnetic field is provided within the vacuum housing by means of externally located magnetic field windings 46 and 48, these windings producing a magnetic field having lines of force extending parallel to the common axis of the anode 33 and the cathode 40. It will be noted that for the magnetic field lines to pass between the anode and the cathode electrodes, it is necessary for the field to penetrate the cathode at some point outside the coils 46 and 48. Since penetration of the field requires a finite amount of time, the magnetic field, which is generated by pulsed signals, must be applied prior to the operation of the magnetically insulated reflex triode ion beam generator to permit time for the field to penetrate the cathoe and anode structures. The cathode is provided with two openings, illustrated at 50 and 52, which permit the escape of ions.

In operation, a strong magnetic field is supplied to the device by means of coils 46 and 48, the magnetic field being of sufficient strength in a direction transverse to the accelerating gap between the cathode and the anode to deflect electrons which are drawn off the cathode by field emission upon the application of a high voltage to the anode by way of line 42. As an example of the magnitude of the field necessary, with a gap voltage of 200 keV and an anode to cathode spacing of 0.5 cm, the magnetic field must exceed 3 kG for insulation. However, a field strength of up to 11 kG may be used in very short duration pulsed fields.

Since the magnetic insulating field deflects the electrons away from the anode surface, creation of a plasma must occur by some means other than bombardment from the emitted electrons. It has been found that through the use of nylon strings about 0.03 cm thick with a spacing of 0.3 cm around the anode, for example, the application of a very high anode voltage to one of the armatures 36 creates a large axial electric field along the strings 38. It is believed that this electric field causes a surface breakdown along all of the nylon strings at approximately the same time to form a dense plasma surrounding the anode. This plasma is maintained by the current which is drawn to supply the ion losses as ions are drawn from the plasma toward the cathode 40. The use of numerous parallel strings produces a large area of uniform plasma. Ions travelling from the anode plasma toward the cathode may escape from the cathode through the apertures 50 and 52 for collection. In the illustrated embodiment, collection may be in a collecting probe 54, or into an instrument such as a spectrometer vacuum chamber extension 56. As illustrated by the arrow 58, the ions entering the spectrometer chamber 56 are deflected in a curved path by the magnetic field from coils 46 and 48, but the radius of curvature is much smaller than that of the electrons, and accordingly the ions are permitted to escape from the system.

It will be noted that the acceleration of ions across the anode-cathode gap only occurs for a short period of time. Then, the plasma surrounding the anode expands to reduce the size of the gap and eventually to close it, ending the production of ions. After the end of the high voltage pulse applied to the anode, the accumulated electrons on the cathode are accelerated toward the anode, striking the anode material to produce X-rays. Further, if there should be a polarity reversal at the end of the applied pulse, electrons from the plasma will flow to the cathode, striking the metal surface thereof to emit additional X-rays. However, the emission of X-rays occurs long after the production of plasma and the ion beam. Measurement of the ion current densities produced by the generator of FIG. 4 indicate that the efficiency is close to 100 percent because there is no electron travel from the cathode to the anode. A further description of the theoretical basis of the structure of FIGS. 4 and 5 may be found in an article entitled "Production of Intense Proton Fluxes in a Magnetically Insulated Diode", published in the *Journal of Applied Physis,* Vol. 47, No. 1, January, 1976, pages 85 – 87.

The structure of FIGS. 4 and 5, therefore, produces a substantial flow of ions, however, because of the geometric shape of the anode, these ions follow divergent paths toward the surrounding cathode. To overcome this problem of a diverging ion flow, the geometry of FIGS. 4 and 5 may be be reversed, as indicated in FIG. 6, so that the anode is located exteriorly of the cathode, whereby the ions will travel radially inwardly. Because of the curvature applied to the ions by the magnetic field, the ions do not all pass through the axis of the cathode in such an arrangement, but nevertheless a good current density can be obtained with this configuration.

In the ion beam generator of FIG. 6, the reflex triode generally illustrated at 60 is mounted within a vacuum housing 62, which is surrounded by magnetic field coils 64 and 66, substantially as in the construction of FIG. 4. However, in this case the anode structure is located outside the cathode structure, the cylindrical cathode 68 being secured by a suitable support 70 which extends to a ground point. The high positive voltage from the Blumlein line is applied by way of a cylindrical conductor 72 to anode 74 which is coaxial with and supported exteriorly of the cathode. Whereas in the device of FIG. 4, the cathode was simply a solid surface of stainless steel with small holes for the extraction of part of the ion beam, with nylon strings forming the surface of a cylinder for the anode, it was found that in the reversed configuration of FIG. 6, such structures could not be used. First, it was found that any irregularities in the shape of the anode produced unacceptable beam divergence, preventing the ions emitted by the anode from meeting at the axis of the cathode, and difficulties were encountered in supporting the anode mesh material in a close approximation to a cylindrical shape. Further, it was found to be undesirable to operate the system in such a way that the ions released by the anode had to pass through the cathode, thereby depositing a large percentage of the total beam energy on an easily damaged cathode surface. In addition, it was found that to achieve a significant focus of the converging beam, the magnetic field, provided to insulate the cathode from the anode, had to be excluded from the interior of the cathode; otherwise, the ions that managed to reach the interior of the cathode would be curved by the field sufficiently that they could not be focussed at the axis of the device. The configuration of FIG. 6, as illustrated in greater detail in FIG. 7 avoids the foregoing problems.

In the FIGS. 6 and 7 embodiment, the anode 74 consists of a metal cylinder into which circular plugs of a solid hydrocarbon material 76, such as a casting epoxy machined flush with the surface of the cylinder, is provided. The anode cylinder is drilled and the epoxy placed in the resulting apertures and allowed to harden, after which it is machined to the desired surface dimensions. Mounted at the center of each plug 76 is a metal pin 78 which is connected to ground. Since as previously discussed, metal anodes do not produce plasma or ion beams, the present configuration produces ions only from the epoxy portions of the anode. It was found that each circular plug broke down independently when the anode was subjected to the main voltage pulse from the Blumlein line, the electric field between the metal of the anode and the grounded centrally located pins 78 producing a surface breakdown on each of the epoxy plugs to produce a plurality of plasma sources of ions.

The cathode 68 is constructed of a solid metal cylinder with holes 80 drilled therethrough at locations matching the locations of the epoxy circles 76 in the anode. With this construction, the ions produced by the plasma generated at the epoxy plugs can be accelerated toward the cathode and will pass through the holes 80 into the center of the device, as desired. It has been found that this configuration can produce an efficiency of almost 100 percent with proper alignment of the holes with the epoxy plugs. In an operating device constructed in accordance with the structure disclosed in FIGS. 6 and 7, a total anode area of 240 sq. cm was provided with 96 epoxy circles, each of which had a diameter equal to 1.27 cm. The cathode holes 80 produced a transparency of 50 percent which permitted the cathode to maintain its structural integrity, and the device produced 96 individual ion beams directed inwardly toward the interior of the cathode.

In order to prevent diversions of the ion beams so produced, the magnetic field produced by coils 64 and 66 is driven by a pulse source of voltage which is sufficiently short to prevent this field from penetrating the cathode. This effect is enhanced by constructing the cathode of a metal such as copper. If a magnetic field lasting 1 millsecond is applied, the increasing field at the start of the pulse creates eddy currents within the metal of the cathode cylinder, which currents produce an opposite field which lasts sufficiently long to inhibit the penetration of the main magnetic field into the cathode. Thus, the beams passing into the center of the cathode will travel in relatively straight lines, with their divergence being determined by the angle of emission from the epoxy plugs, rather than by the insulating magnetic field, and accordingly good beam focus can be obtained.

If desired, the geometry of the ion beam generator may be further modified by shaping the anode and cathode in generally concentric spherical shapes so that the ion beam is concentrated toward a point, rather than toward an axial line as is the case in the device of FIG. 6.

The intense ion beam available from the generator of the present invention has numerous uses, including the heating of magnetically confined plasmas for controlled fusion and has an alternative to laser and electron beams for the heating and compression of fusion pellets. Although the present invention has been disclosed in terms of preferred embodiments thereof, it will be understood that numerous modifications and variations will become apparent to those of skill in the art. Accordingly, it is desired that the foregoing be considered as illustrative of the inventive concepts, and that the true spirit and scope of the present invention be limited only by the following claims.

What is claimed is:

1. The method of generating intense ion fluxes comprising:

providing an anode surface and a closely spaced cathode surface in a vacuum chamber, said anode surface being substantially transparent to electrons and including a material capable of forming a plasma;

maintaining said cathode surface at a ground reference potential;

applying a pulse voltage in the megavolt range to said anode to produce a plasma at the surface of said anode, said pulse having a duration approximately equal to or less than the time required for said plasma to form and to fill the gap between said cathode and said anode, said pulsed voltage producing an electric field which accelerates electrons from said cathode toward said anode and which accelerates ions formed in said plasma away from said anode;

applying a magnetic field along the cathode-anode axis to confine emitted electrons to the area of the cathode to prevent current loss; and collecting the ions drawn out of said anode plasma, a voltage pulse of 130 nsec producing currents in excess of 5 kA.

2. The method of generating intense ion fluxes as described comprising in claim 1, wherein a small percentage of the electrons accelerated toward said anode strike the anode to generate a plasma at the anode surface, the remainder of said electrons passing through said anode and said plasma and forming a virtual cathode which is transparent to ions, and wherein the ions to be collected pass through said virtual cathode.

3. The method of generating intense ion fluxes, comprising:

providing an anode surface and a closely spaced cathode surface in a vacuum chamber, said anode surface including a material capable of forming a plasma in the presence of an intense electrical field;

applying a high pulsed voltage to said anode, said voltage being of sufficient magnitude to produce a plasma at said anode surface, said pulse having a duration approximately equal to or less than the time required for said plasma to form and to fill the gap between said cathode and anode, said pulsed voltage producing an electric field which accelerates electrons from said cathode toward said anode, and which accelerates ions formed in said plasma away from said anode;

applying an insulating magnetic field between said anode and cathode to produce magnetic field lines of sufficient force to deflect electrons being accelerated toward said anode but insufficient to deflect ions, whereby electrons are prevented from reaching said anode so that substantially all the current flow between the anode and cathode is due to ion flow; and collecting the ions drawn out of said anode plasma.

4. An intense ion flux generator, comprising:

a vacuum housing;

an anode surface located within said housing, said anode surface including a material capable of producing a plasma;

a cathode surface closely spaced to said anode surface, and located within said housing;

means applying a pulsed voltage in the megavolt range to said anode to produce an electric field of sufficient magnitude to produce a plasma at said anode surface;

means for producing a magnetic field between said anode and cathode for constraining electrons emitted by said cathode; and means for collecting ions emitted by said plasma.

5. The apparatus of claim 4, wherein said anode is substantially transparent to electrons, whereby substantially all electrons emitted by said cathode upon application of said pulsed voltage are accelerated toward said anode and pass therethrough, a small percentage of said electrons striking said anode to produce said plasma.

6. The generator of claim 5, wherein said anode and cathode are substantially planar and parallel to each other.

7. An intense ion flux generator, comprising:

a vacuum housing;

an anode surface mounted within said housing, said anode surface comprising a material for producing a plasma;

a cathode surface mounted within said housing, said anode and cathode being concentric and closely spaced to form a gap therebetween;

means for applying to said anode a high intensity voltage pulse said pulse being of sufficient magnitude to break down the material of said anode to produce a plasma; and means for producing an insulating magnetic field having lines of flux extending between said anode and said cathode, said magnetic field being of sufficient magnitude to prevent electrons emitted by said cathode in the presence of said high intensity voltage from reaching said anode, but being sufficiently small to permit ions emitted by said plasma to cross said gap.

8. The generator of claim 7, wherein said anode and cathode surfaces are substantially cylindrical and coaxial.

9. The generator of claim 8, wherein said anode is located radially inwardly of said cathode, said ions travelling radially outwardly from said anode.

10. The generator of claim 8, wherein said anode is located radially outwardly of said cathode, said ions travelling radially inwardly from said anode.

11. The generator of claim 10, wherein said cathode is perforated to permit the passage of said ions therethrough.

12. The generator of claim 11, wherein said anode is formed of a metallic cylinder carrying a plurality of plugs of plasma-forming material, each plug of said plasma-forming material being located in radial alignment with a corresponding perforation in said cathode, whereby application of an intense voltage pulse to said anode produces an ion beam from each plug which flows radially inwardly through said perforations toward the axis of said cathode.

13. The generator of claim 12, wherein each of said plugs carries a central conductive pin at ground reference potential to facilitate the formation of plasma.

14. The generator of claim 12, wherein said cathode is of an electrically conductive metal and wherein said insulating magnetic field is a pulsed field, said pulse field producing eddy currents in said cathode which prevent said magnetic field from extending into the center of the cathode, whereby ions flowing into said cathode are not deflected by said magnetic field.

15. The generator of claim 7, wherein said anode comprises a mesh formed of nylon string, the string being secured between spaced supports and defining the surface of a cylinder, said nylon string producing a plasma upon application of a high intensity voltage pulse.

* * * * *